US006401406B1

(12) United States Patent
Komara

(10) Patent No.: US 6,401,406 B1
(45) Date of Patent: Jun. 11, 2002

(54) RETAINMENT DEVICE FOR CONCRETE BLOCK INSPECTION PLATES

(76) Inventor: Donald K. Komara, 905 E. Parkway Dr., Stuart, FL (US) 34996

( * ) Notice: Subject to any disclaimer, the term of this patent is extended or adjusted under 35 U.S.C. 154(b) by 0 days.

(21) Appl. No.: 09/504,769

(22) Filed: Feb. 11, 2000

(51) Int. Cl.[7] ..... E04B 1/02

(52) U.S. Cl. ..... 52/127.3; 52/98; 52/306; 52/421; 52/514

(58) Field of Search ..... 52/306, 307, 606, 52/607, 421, 98, 514, 127.3, 127.4; 249/19, 33, 40, 177; 411/435, 437

(56) References Cited

U.S. PATENT DOCUMENTS

| | | | | | |
|---|---|---|---|---|---|
| 781,571 | A | * | 1/1905 | Thomas | 411/437 |
| 3,458,184 | A | * | 7/1969 | Schlosser | 269/287 |
| 3,904,717 | A | * | 9/1975 | Stegmeier | 249/34 |
| 4,000,591 | A | * | 1/1977 | Courtois | 52/689 |
| 4,354,332 | A | * | 10/1982 | Lentz | 52/514 |
| 4,387,877 | A | * | 6/1983 | Deason | 249/9 |
| 4,729,540 | A | * | 3/1988 | Rozema | 249/1 |
| 4,848,056 | A | * | 7/1989 | Kelly | 52/514 |
| 5,065,560 | A | | 11/1991 | Yoder | |
| 5,117,605 | A | * | 6/1992 | Waldbeiser | 52/514 |
| 5,269,114 | A | | 12/1993 | Albers et al. | |
| 5,868,537 | A | * | 2/1999 | Latal et al. | 411/437 X |

* cited by examiner

*Primary Examiner*—Beth A. Stephan
*Assistant Examiner*—Brian E. Glessner
(74) *Attorney, Agent, or Firm*—McHale & Slavin

(57) ABSTRACT

Disclosed is a retainment system for concrete block inspection port coverplates. The retainment device is formed from a hook-shaped engagement shaft that is positionable around rebar through an inspection opening. A proximal end of the engagement shaft protrudes from the concrete block opening and is available for placement through an inspection opening coverplate. Either a U-shaped locking nut can be used to secure the coverplate to the engagement shaft, or the coverplate itself includes integrated annular grooves as a locking mechanism. The device provides for simplistic covering of any standard inspection opening, and the use of transparent plates providing an uninhibited view of the rebar presence and condition, even when the retainment device is mounted. The use of annular grooves placed perpendicular to the length of the shaft, allow for ease of shaft disengagement from the wall upon curing of the cement, providing a flush surface to either be left exposed or for placement of stucco thereon.

6 Claims, 2 Drawing Sheets

RETAINMENT DEVICE FOR CONCRETE BLOCK INSPECTION PLATES

FIELD OF THE INVENTION

This invention is directed to the field of concrete block construction and, in particular, to retainer device that allows for the inspection of steel reinforcement and concrete core filling.

BACKGROUND OF THE INVENTION

The technique of reinforcing hollow concrete blocks is a well accepted building practice for use where added wall strength is necessary. Steel reinforced concrete and masonry construction provides numerous benefits over other construction systems including resistance to insect infestation and decomposition due to moisture and other environmental exposure. Reinforced concrete masonry is commonly incorporated into very economically and environmentally efficient wall systems. Reinforcing hollow concrete block with steel rods embedded therein is ideal for use in buildings prone to abnormally severe environmental conditions, such as high winds due to hurricanes. Geographical areas such as Florida and other coastalregions prone to high winds, have adopted strong building construction codes and regulations regarding reinforced concrete block and the inspection thereof.

Current practices include the use of steel reinforcement bars, commonly referred to as rebar, that are placed into the hollow-core concrete blocks and anchored to a concrete foundation or footing. The concrete foundation includes reinforcing rods, either embedded therein or including a means for securing thereto, wherein the rebar extends vertically upward into concrete block walls and horizontally at beams, and spaced apart at distances established by structural calculation and local building codes. Such rebar may be placed at intervals from sixteen inches to eight feet, and at each comer of a wall structure, and beside each opening, depending upon the height of the wall and other factors of the structure. To ensure that building regulations are met, building inspectors view the wall to foundation securement through inspection holes through one face of the concrete block. The inspection holes must be securely covered during the concrete filling of the hollow-block wall, the concrete permanently fixing the rebar in position, and the cover retaining the concrete within the block cells.

Currently there are several methods for preparing an inspection viewing port. The viewing port may be formed by cutting a hole through the concrete block by use of a saw, chipping a hole through the concrete block by use of a mason's hammer, or by use of a specialty concrete block being formed during manufacture. Said openings are formed for the purpose of inspection of the steel reinforcement and subsequent filling of the block cell with concrete.

A basic inspection hole must be covered after inspection by a plate made of plastic, wood, or any other suitable rigid material. Most commonly pieces of plywood are placed over each hole and fastened to the surrounding block with certain nails driven with a hammer or by pneumatic gun. The nails often crack the surrounding block surface. Should the weakened patch fail while concrete is being inserted, the results would be the loss of a cubic yard or more of concrete, time and labor to remove the wasted concrete, and possibly further delay of the work. Nailed-on plywood inspection hole covers have other disadvantages. Installation and removal of plywood covers is time consuming. The pneumatic gun requires an air compressor and electric power. The air hoses must be dragged around the building's entire perimeter. Plywood covers can be used twice without removal of nails from prior use. In order to use plywood covers a third time, nails from at least one prior use must be removed by hand. Transport, handling, and storage of plywood covers with protruding nails is difficult.

Due to the disadvantages associated with nailed-on plywood inspection plate covers, a number of attempts have been made to provide alternative closure techniques pertaining to the inspection port securement. U.S. Pat. No. 5,065,560 discloses a concrete block inspection form which consists of a specially manufactured hollow concrete block having a preformed opening. The block is sold as a kit which includes an inspection plate cover that is sized for the preformed opening. The disadvantages of such preformed block are the added expense required for the specialty concrete block which also include special care and shipping. Since these blocks are used only for inspection, the exact number of blocks must be calculated for extra blocks would be discarded or need to be returned. However, if the exact number of blocks is ordered, should any block be damaged during installation, additional blocks may need to be ordered which could delay construction. Further, the modified concrete block is not suitable for all installations as a portion of the wall has been removed.

U.S. Pat. No. 5,269,114 discloses yet another cover retainer for a concrete block inspection plate. This invention includes the use of a flange that fits inside the opening of the concrete block, and is rotated so as to engage the inner sidewalls of the concrete block with an attachment nut securing an outer cover plate, which engages the outer surface of the concrete block in a proximal relationship to the wall. In this manner concrete may be placed through the hollow concrete block, where it forms around the securement mechanism. Once the concrete has solidified, the cover may be removed by disengaging the threaded locking nut from the plate and removing the plate from the outer surface of the sidewall. This device does not address various size openings, and is limited to engaging those openings that have clear access along the inner wall, and have a predetermined width regarding the opening for placement therein. This device also requires the concrete block to be preformed, which again adds to the expense of installation by requiring pre-made concrete blocks with openings of a predetermined size. The associated risk for installation of precut blocks remains the same, and shipment requires additional care to prevent premature damage of the blocks.

Thus, what is needed in the art is a retainment system for inspection port covers allowing for flexibility with respect to position of the reinforcing rod, and in the size of inspection holes, and thus, the method of creating the hole, thereby eliminating the need for specially cut or formed blocks and the associated costs for shipping, storing, and placement. In addition, the method must be strong and relatively failsafe in containment of the concrete fill. Also needed is a system simple to install, dismantle, and store for reuse.

BRIEF SUMMARY OF THE INVENTION

The instant invention consists of shaft having annular grooves and a hook shaped end. The device is positioned with hooked end around the rebar, extending through the inspection hole into and through the aperture of a cover plate. In the primary embodiment, the cover plate consists of a flat plate with an offset disposed aperture. The cover plate incidentally will be made of clear plastic providing rigidity and transparency. A U-shaped nut is then employed having grooves to engage the annular grooves of the shaft thereby coupling the nut to the shaft. In this manner, the closure plate is held securely in place by the nut, frictionally engaging the plate against the outer wall surface of the concrete block, prohibiting poured concrete from flowing therethrough. The use of the clear plastic plate further allows for additional inspection of the rebar before and during pouring of the concrete.

In another embodiment, the clear plastic plate includes a slot having annular grooves for engaging the annular grooves on the shaft. The second embodiment eliminates the need for a secondary nut and is useful when horizontal access to the inspection hole is available.

Yet another embodiment includes the use of a hook-shaped shaft having directional tabs. In this embodiment, the shaft is placed through an aperture of a cover plate where the directional tabs engage the cover plate during the sliding of the cover plate, thereby securing the plate in juxtaposition to the outer surface of the concrete block.

Each of the embodiments include a grooved shaft that allow the excess portion of the shaft to be broken free once the concrete has cured. The annular grooves provide various disengagement points along the length thereof, wherein the exact length is determined after the concrete has been poured. Removal of the inspection plate simply requires the use of a hammer to cause breakage of the shaft along the surface of the concrete providing smooth flush surface that can be stucco over without further preparation.

Thus, an objective of the instant invention is to provide an apparatus for ease of covering an inspection hole in a concrete block installation.

Yet another objective of the instant invention is to provide a cost effective method of closure over viewing ports for inspection of reinforcement steel that is universal in application, does not require preformed inspection blocks or form-fitting inspection plate covers.

Still another objective of the instant invention is to provide a retainment device that secures directly to the reinforcement steel, regardless of various reinforcement positions, said retainment device allowing full flow around the reinforcement steel and within the block cavity.

Yet still another objective of the instant invention is to provide various locking embodiments that allow the use of a various sized inspection holes and plate, or pre-sized inspection plates wherein the locking nut is incorporated thereto.

Still another objective of the instant invention is to readily retain over the inspection port, a clear access plate cover providing an uninhibited view to the steel reinforcement and to verify steel reinforcement positioning before and while concrete is being inserted, and to observe that concrete has flowed fully to the bottom of the cell, ensuring that no obstruction has prevented such.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
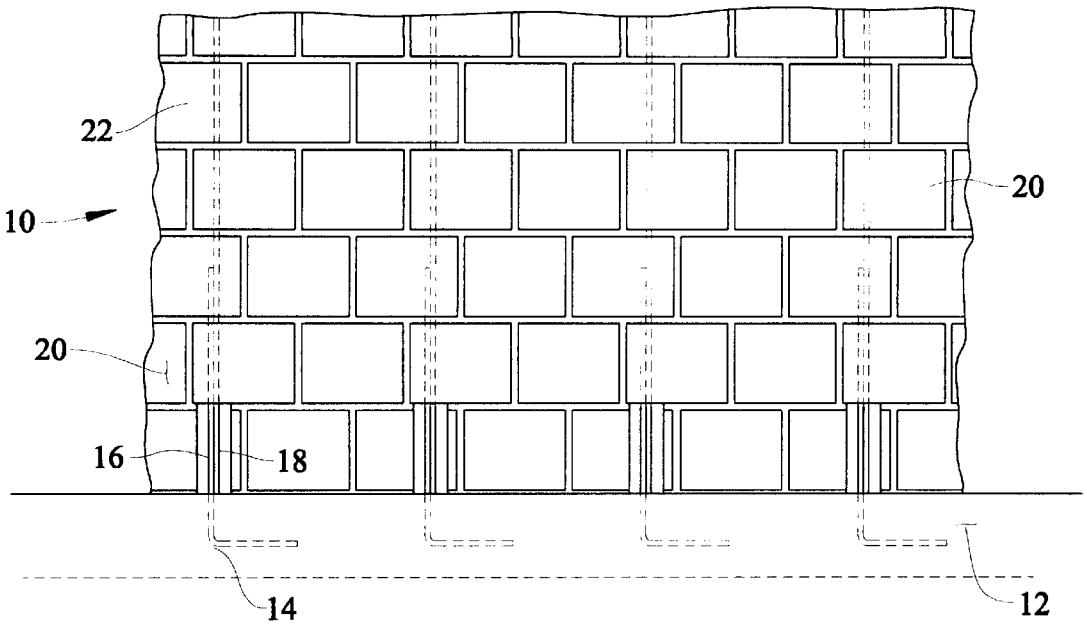
FIG. 1 is a partial pictorial view of a portion of a concrete wall depicting inspection openings revealing reinforcing rods.

Referring now to FIG. 1, depicted is a typical concrete wall construction 10 consisting of a concrete foundation 12, with a plurality of concrete blocks positioned thereupon. Within the foundation is a horizontally bent portion 14 with vertical extension thereof exposed rebar 16 that can be seen within inspection port 18 of concrete block 20. In construction of walls designed to withstand high wind loads, rebar 22 is placed through the hollow blocks and secured to foundation rebar 14 at inspection opening 18. Coupling rebar together is typically accomplished by the use of metal wire tie with care to center the rebar allowing sufficient concrete encasement/coverage. The coupled encased rebar provides rigidity between foundation 12 and masonry wall 10.

The inspection opening 18 provides a building inspector the ability to view the steel reinforcement and coupling to assure that it meets code regulation. The inspection opening also provides the ability to check if concrete has formed around the coupling used to solidify the wall in relation to the rebar.

Figure 2:
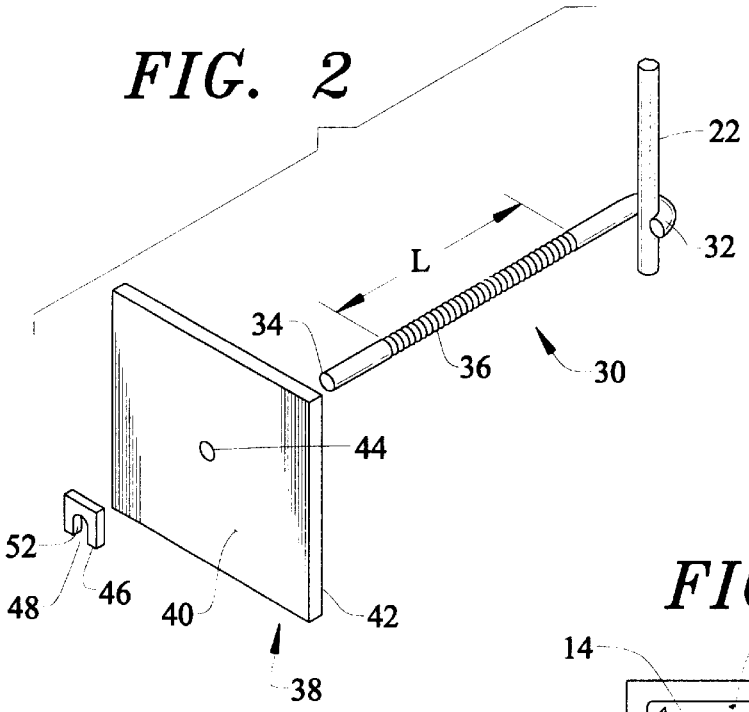
FIG. 2 is an exploded view of the component parts comprising a first embodiment of the invention.

Referring to FIG. 2, shown as an exploded view of the preferred embodiment of the instant invention, wherein rebar 22 is depicted in a hooked relationship with engagement shaft 30, having a distal radiused end 32 forming a hook shape, and in a proximal end 34, separated by a length L therebetween. The length L may be approximately 6 inches based on common block or of such a length to allow coupling to the steel reinforcement while a sufficient portion of the shaft protruding from the inspection hole. The proximal end 34 includes annular grooves 36 along a portion of said length. The preferred inspection plate 38 is typically formed from a square or rectangular piece of material, preferably clear plastic, having an outer surface 40 and an inner surface 42. The inner surface 42 is juxtapositioned along the surface of the concrete block, forming a seal thereto. In operation, the plate 38 includes an offset disposed aperture 44 that is slidably insertable over the proximal end 34 of the engagement shaft 30 for positioning along the shaft at a portion where the distal end 32 is securely hooked around the rebar 22, with the inner surface 42 flush against the outer surface of the concrete block 54, thereby leaving the proximal end 34 and portion of the annular grooves 36 protruding through aperture hole 44. A fastening means is then used to secure the inspection plate 38 in position along the engagement shaft 30. In the preferred embodiment, the fastening means consist of a U-shaped nut 46 having a centrally disposed slot 48 with a plurality of annular grooves, which are reciprocal to the annular grooves 36 of the engagement shaft 30. The installer locks the inspection plate 38 to the engagement shaft 30 by placing sliding lock nut 46 over the annular grooves 36, where cooperating grooves 52 engage reciprocal grooves, thereby locking the face plate 38 in a fixed position.

Figure 3:
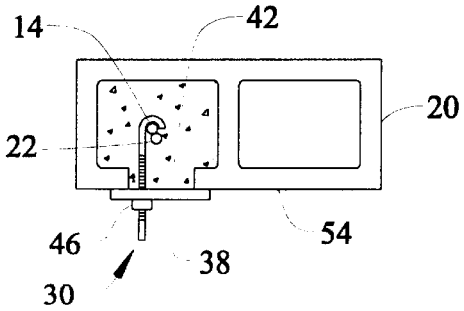
FIG. 3 is a plan view of the apparatus installed within a hollow concrete block.

If the inspection plate 38 is made of clear plastic, this installation can be performed before an inspector arrives, as the rebar coupling can be viewed directly through the inspection plate with minimal interference in view of the simplistic hook-shaped attachment provided by this invention. In any event, upon securement of the lock nut to the engagement shaft, concrete may then be poured through the wall causing the rebar to be permanently embedded within the cured concrete. Once the concrete is cured, lock nut 46 may be removed easily from the engagement shaft, where inspection plate 38 is slid over the proximal end 34 of the protruding engagement shaft, and a blunt object may be used to snap the protruding portion of the engagement shaft 30 from sticking outward from the now-filled inspection hole. The annular grooves provide ease of sliding nut disengagement, and with minimal effort, the engagement shaft may be broken along the face of the concrete block. The engagement shaft 30 is formed from plastic to prevent bleeding from exposed steel throughout the life of the installation. As shown in FIG. 3, the engagement shaft 30 is hooked around the rebar 14 and 22 with face plate 38 having inner surface 42 placed against to the outer surface 54 of concrete block 20, and locking nut 46 maintaining the face plate 38 against the surface of the block 20 with locking nut 46 maintaining the assembly in position.

Figure 4:
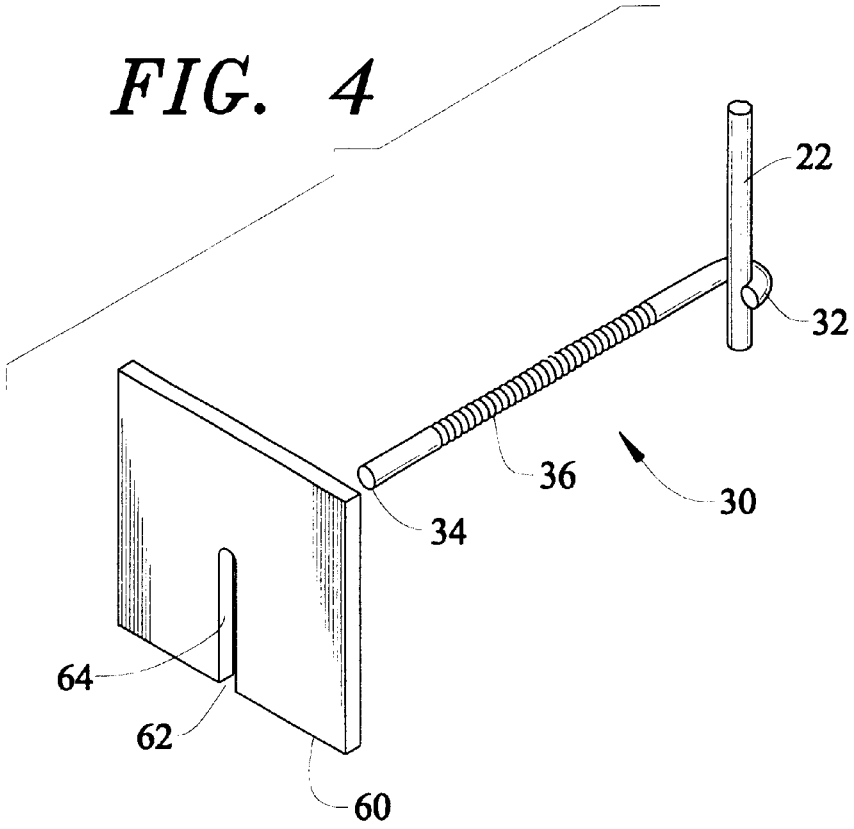
FIG. 4 is an exploded view depicting the components of the second embodiment of the instant invention.

FIG. 4 depicts a second embodiment of the invention having rebar 22 forming a secure base for engagement shaft 30, having a distal end 32 forming a hook shape with a proximal end 34, containing a plurality of annular grooves 36. In this embodiment face plate 60 may be formed of a rigid material with a slot 62 centrally disposed, having a plurality of annular grooves 64, which provide for direct attachment to the annular grooves 36 of engagement shaft 30. In this embodiment, the face plate further operates as the locking nut, thereby eliminating a third component, which is beneficial in those installations having sufficient room to slide the inspection plate over the facade of the concrete block opening.

As with the primary embodiment, after the hollow concrete blocks have been filled, the proximal end of the engagement shaft 30 may be disengaged from the shaft by use of a blunt object, causing the shaft to crack along one of the annular grooves that is adjacent to the outer surface of the concrete block.

Figure 5:
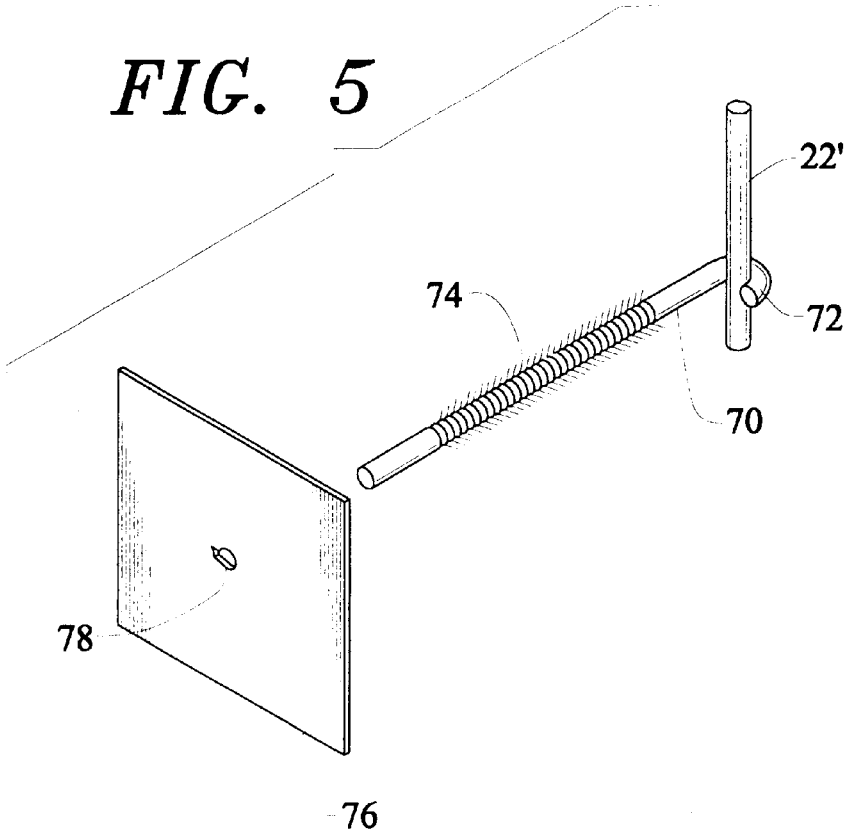
FIG. 5 is an exploded view of a third embodiment of the instant invention.

Referring now to FIG. 5, shown is yet another embodiment wherein rebar 22 is used by engagement shaft 70, having a distal end 72 forming a hook shape, with a proximal end 74 containing a plurality of angularly oriented flexible tabs, which extend radially from such shaft in a direction so as to engage an aperture opening of an inspection plate as it is slid from the proximal end 74 towards the distal end 72. In this embodiment, face plate 76 includes a centrally disposed aperture 78 positionable over the proximal end 74 of engagement shaft 70, wherein sliding of the face plate 76 along engagement shaft 70 causes a locking by the angularly-oriented flexible tabs, which extend radially from said shaft to prevent removal of the face plate once installed. As with the previous embodiments, if the face plate 76 is clear, inspection can still be performed uninhibited, by allowing an inspector to simply view, through the opening, through the transparent shield, to the Rebar attachment. Once inspection is complete, the concrete may be poured through the concrete blocks for solidification around the Rebar and engagement shaft. Once the concrete is poured, the face plate 56 may be hit by a blunt object, which will cause a shearing of the engagement shaft 76 along the facade of the concrete block. In this embodiment, the engagement shaft is formed from a rigid plastic, allowing for ease of shearing upon curing of the concrete.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. The combination of a reinforced wall having an inspection opening and a removable inspection plate with a retainment device for temporary closure and visual inspection, said combination comprising a wall having an inspection opening through the exterior surface, said reinforced wall including interior rebar, said inspection plate being transparent and of a size larger than said inspection opening, said plate having an aperture therethrough, a retainment device having an elongated shaft of a length exceeding the distance between said rebar and said exterior surface, one end of said shaft hook shaped and engaging said rebar, the other end of said shaft passing through said aperture, said other end of said shaft having a plurality of spaced apart annular grooves, and a fastening means for connecting said shaft and said plate together, said fastening means cooperating with said spaced apart annular grooves to fix said plate along the length of said shaft in contact with said exterior surface about said inspection opening, whereby said plate closes said inspection opening while allowing visual inspection of said rebar.

2. The combination of claim 1 wherein said plate has peripheral edges, said aperture comprises a slot in said plate, said slot extending from a peripheral edge to an inner end and said fastening means includes said inner end of said slot cooperating with said annular grooves.

3. The combination of claim 1 wherein said annular grooves form lines of weakness in said shaft, said lines of weakness facilitating breaking said shaft.

4. The combination of claim 1 wherein said shaft is hooked about said rebar, said plate is fixed on said other end of said shaft in contact with said exterior surface about said inspection opening closing said inspection opening whereby after visual inspection of said rebar, said interior of said wall and said inspection opening are filled with wet cement, said plate preventing escape of said cement from said inspection opening, and after said cement cures said fastening means and said plate are removed from said annular groove forming a circumferential line of weakness about said shaft, said shaft is adapted to be broken at said annular groove.

5. The combination of claim 1 wherein one end of said shaft hook shaped to engage said rebar, said other end sized to pass through said aperture, said other end having a plurality of spaced apart radially oriented tabs, the radius of said tabs and said shaft being larger than said aperture, said tabs cooperating with said aperture to fix said plate along the length of said shaft.

6. The combination of a removable inspection plate and retainment device for temporary closure and visual inspection of the interior of a reinforced wall having an inspection opening through the exterior surface, said reinforced wall including interior rebar, said combination comprising a transparent inspection plate of a size adapted to be larger than said inspection opening, said plate having an aperture therethrough, a retainment device having an elongated shaft of a length adapted to exceed the distance between said rebar and said exterior surface, one end of said shaft hook shaped for engaging said rebar, the other end of said shaft sized to pass through said aperture, said other end of said shaft having a plurality of spaced apart annular grooves, and a fastening means for connecting said shaft and said plate together, said fastening means adapted to cooperate with said spaced apart annular grooves to fix said plate along the length of said shaft for contact with said exterior surface about said inspection opening, whereby said plate is adapted to close said inspection opening while allowing visual inspection of said rebar wherein said fastening means includes a U shaped nut, said nut having cooperating structure engaging said annular grooves.

* * * * *